US006321628B1

(12) United States Patent
Van Hemelrijk

(10) Patent No.: US 6,321,628 B1
(45) Date of Patent: Nov. 27, 2001

(54) KNIFE FOR CUTTING TUBEROUS PLANTS, MAINLY POTATOES, INTO RODS OR OTHER SHAPES

(75) Inventor: Theophiel Mark Van Hemelrijk, Aartselaar (BE)

(73) Assignee: Stumabo International N.V., Aartselaar (BE)

( * ) Notice: Subject to any disclaimer, the term of this patent is extended or adjusted under 35 U.S.C. 154(b) by 0 days.

(21) Appl. No.: 09/403,322

(22) PCT Filed: Feb. 16, 1999

(86) PCT No.: PCT/BE99/00021

§ 371 Date: Dec. 30, 1999

§ 102(e) Date: Dec. 30, 1999

(87) PCT Pub. No.: WO99/41043

PCT Pub. Date: Aug. 19, 1999

(30) Foreign Application Priority Data

Feb. 16, 1998 (BE) ..... 9800112
May 14, 1998 (BE) ..... 9800365

(51) Int. Cl.[7] ..... B26D 1/02

(52) U.S. Cl. ..... 83/856; 83/857; 144/184; 144/190

(58) Field of Search ..... 83/856, 857, 858; 144/184, 190

(56) References Cited

U.S. PATENT DOCUMENTS

| | | | | |
|---|---|---|---|---|
| 1,824,798 | | 9/1931 | Altfather | 83/426 |
| 2,487,431 | * | 11/1949 | Floyd | 83/857 |
| 2,645,262 | * | 7/1953 | Marasco | 83/857 |
| 4,766,793 | * | 8/1988 | Fischer et al. | 83/857 |

FOREIGN PATENT DOCUMENTS

| | | | |
|---|---|---|---|
| 0 295 004 A2 | 12/1988 | (EP) | B26D/1/00 |
| 643708 | 9/1950 | (GB) . | |

* cited by examiner

*Primary Examiner*—W. Donald Bray
(74) *Attorney, Agent, or Firm*—Fitch, Even, Tabin & Flannery

(57) ABSTRACT

The invention relates to a knife for cutting tuberous plants, mainly potatoes, into bars and other shapes, whereby the tubers are driven through a cutting bloc, which cutting block is formed by the positioning of crosswise mounted, knives situated above each other, which knives consist of a blade with an oblique cutting edge (2) and a flat cutting edge (3) which arc positioned with respect to each other in that said knife are positioned in sleeves (4) provided perpendicularly to this cutting edge of the blade, characterised in that each sleeve (4) shows an oblique cut bottom side (5', 6', 7', 8').

9 Claims, 10 Drawing Sheets

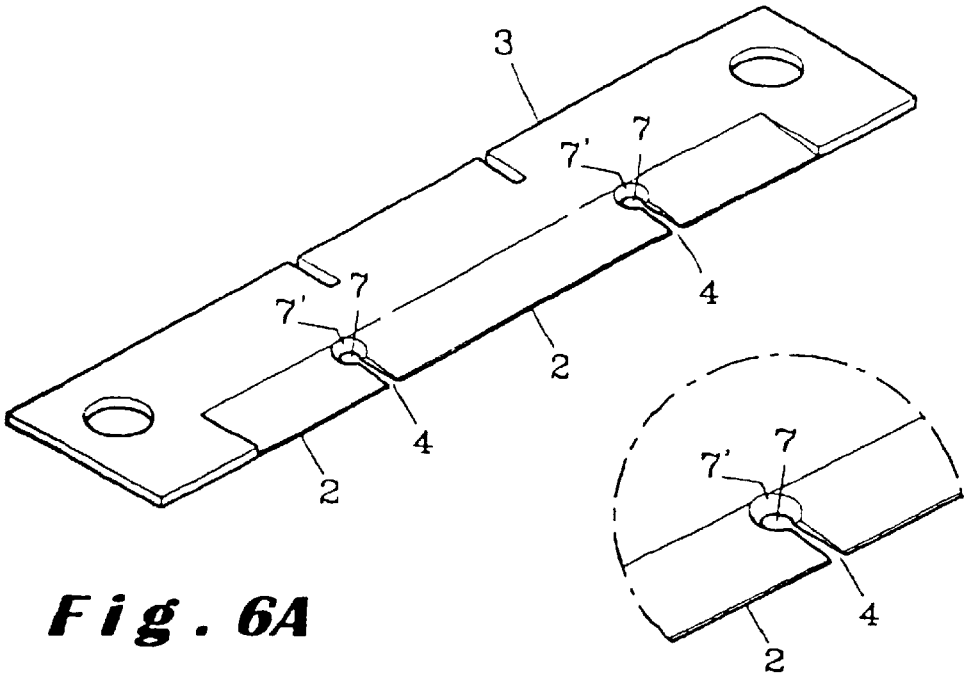
Fig. 6A
Fig. 6B
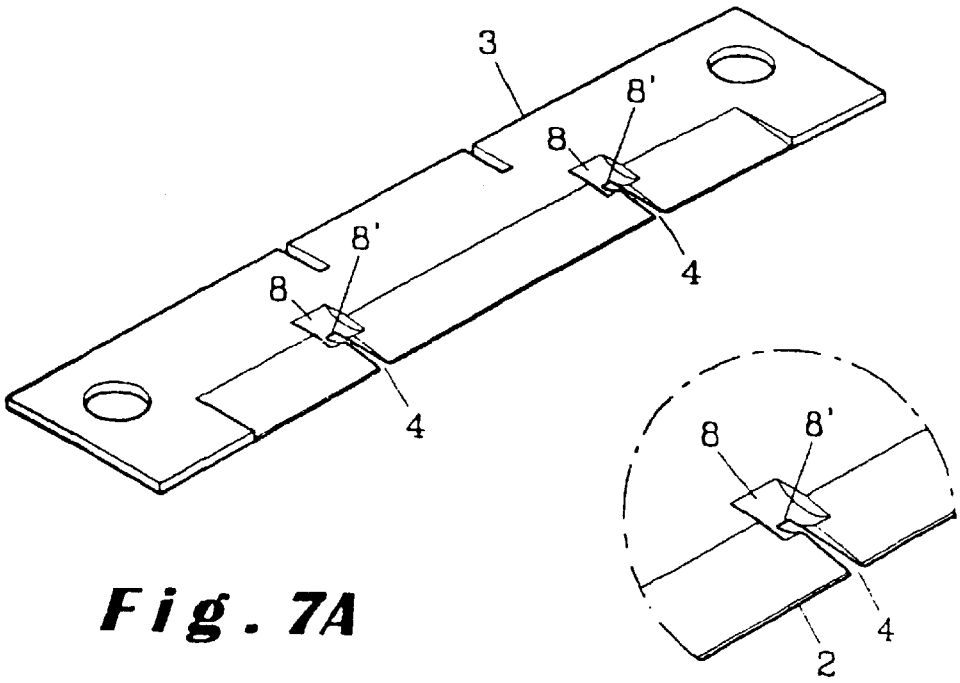
Fig. 7A
Fig. 7B

Fig. 10A
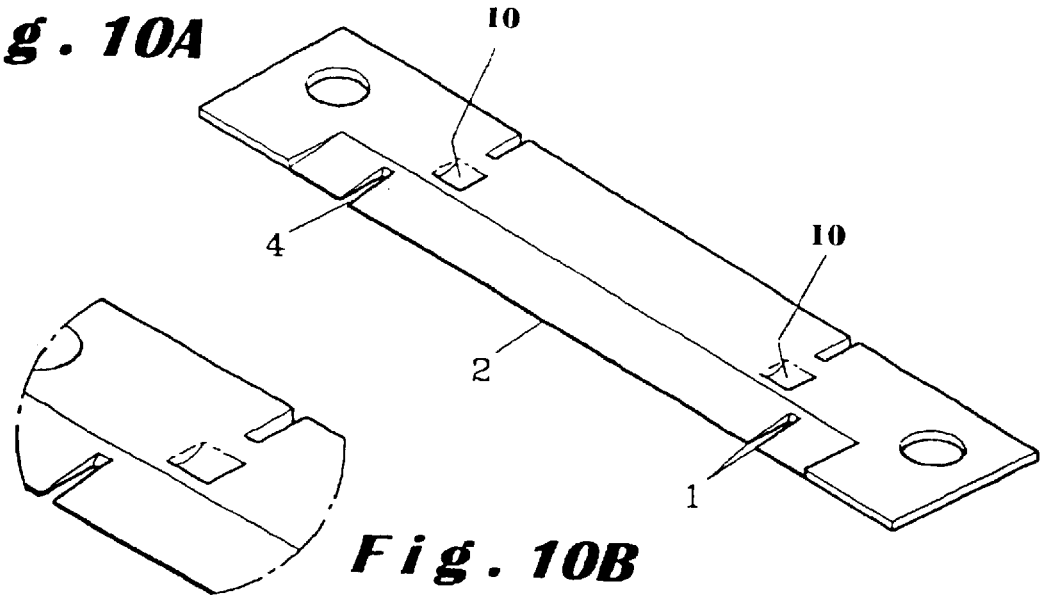
Fig. 10B
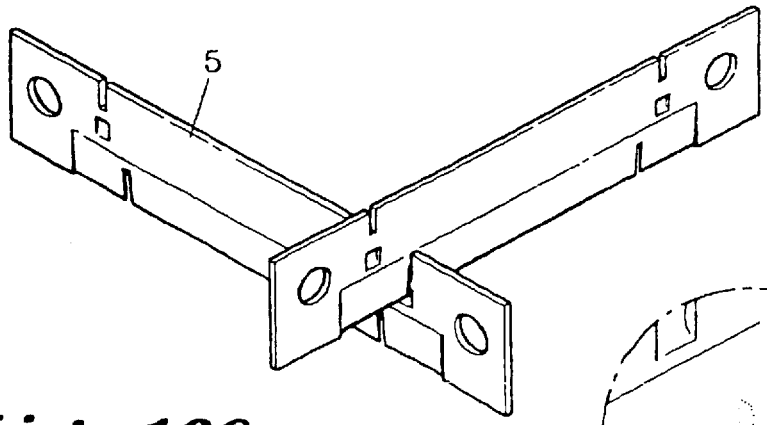
Fig. 10C
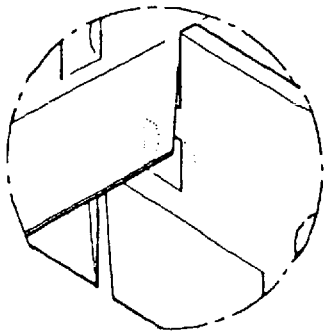
Fig. 10D

Fig. 11A
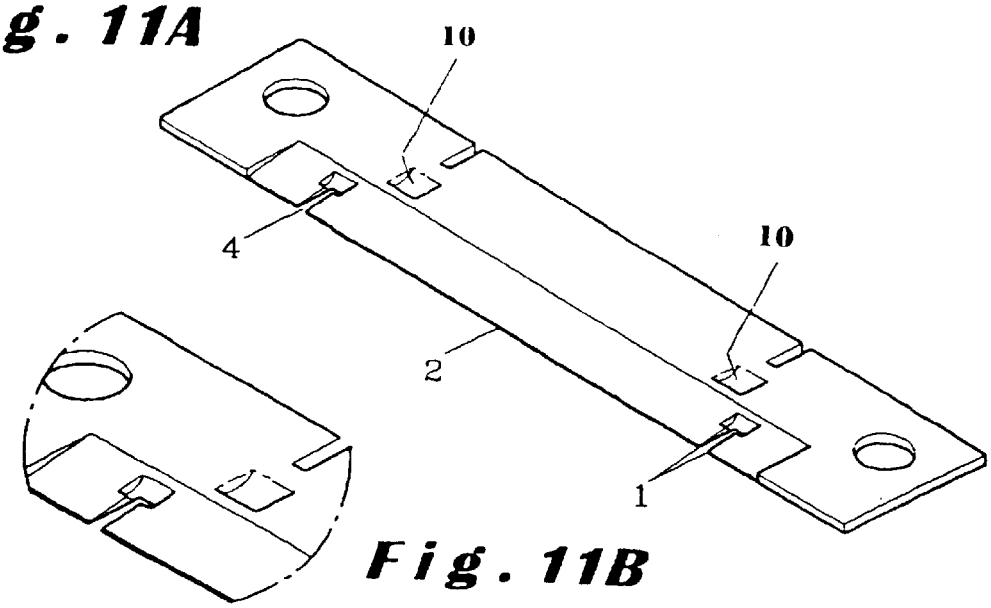
Fig. 11B
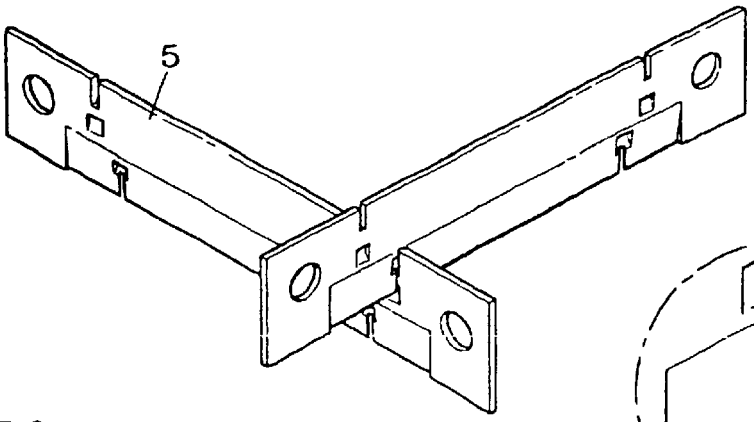
Fig. 11C
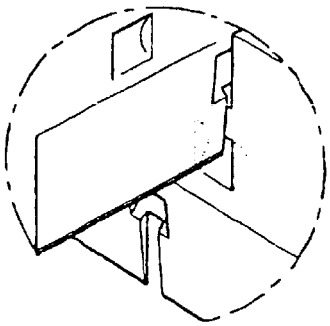
Fig. 11D

Fig. 12A
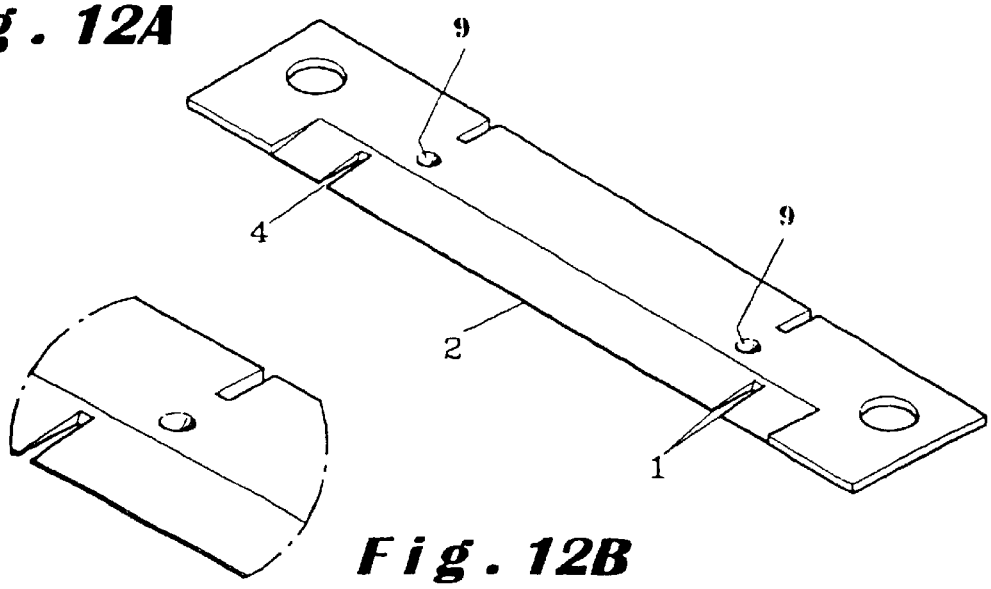
Fig. 12B
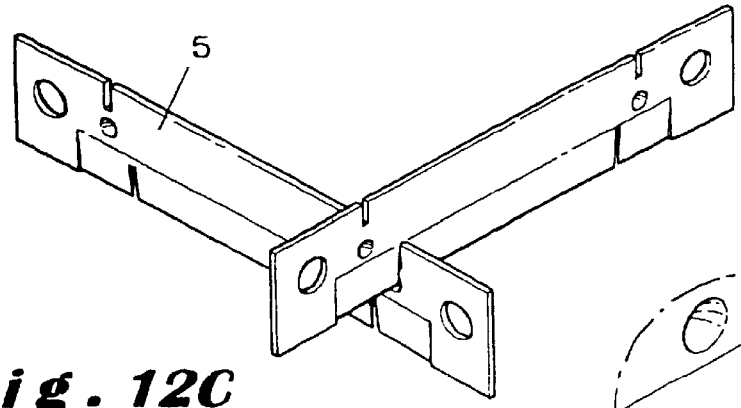
Fig. 12C
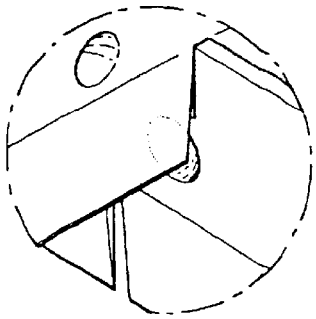
Fig. 12D

Fig. 13A
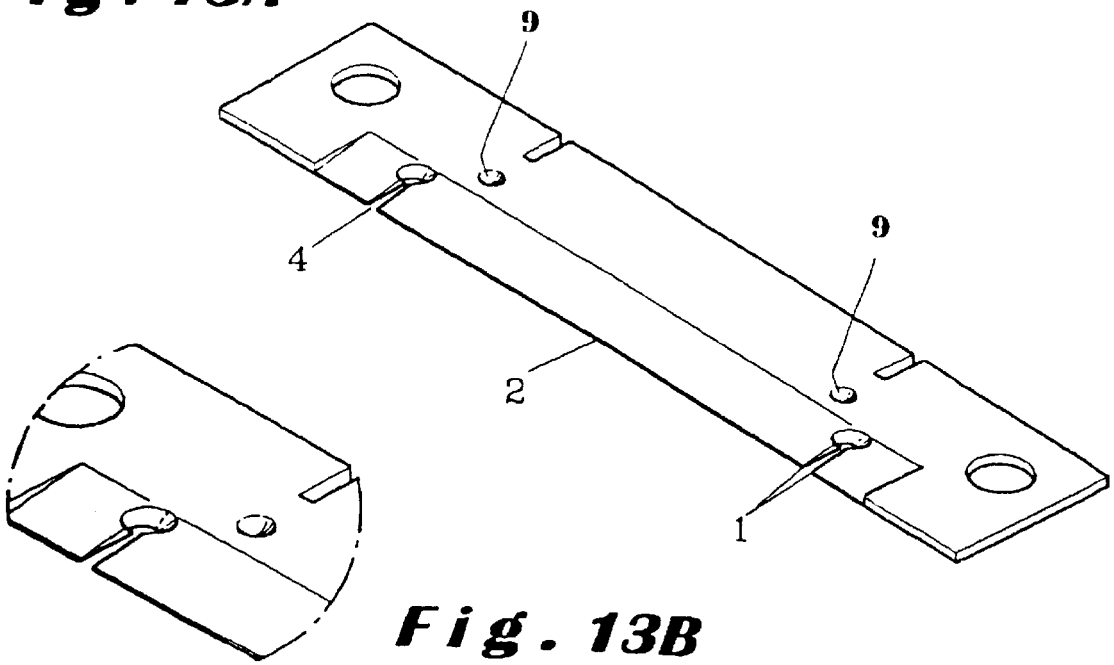
Fig. 13B
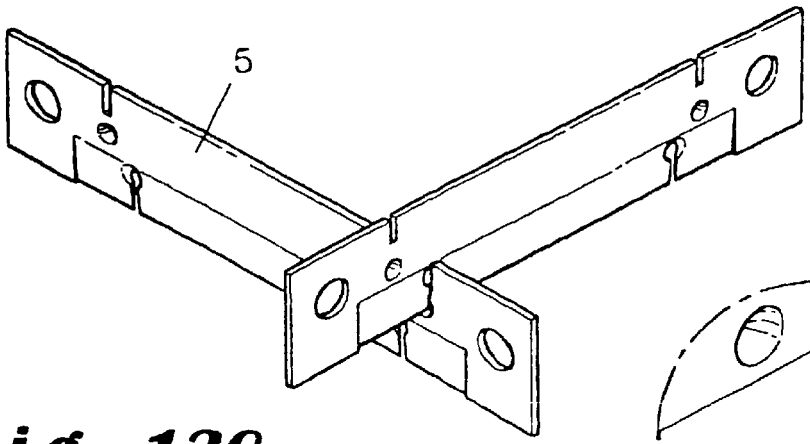
Fig. 13C
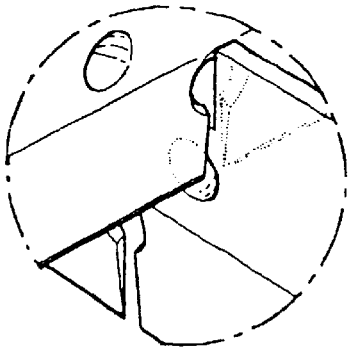
Fig. 13D

KNIFE FOR CUTTING TUBEROUS PLANTS, MAINLY POTATOES, INTO RODS OR OTHER SHAPES

This invention relates to a knife for cutting tuberous plants into bars and other shapes, in a direction whereby the tubers are driven through a cutting bloc in a hydraulic way, which cutting block is formed by crosswise mounted knives, situated above each other, which knives consist of a blade with an oblique cutting edge and a non set flat edge and which are further positioned with respect to each other in that said knives are positioned in sleeves provided perpendicularly to this cutting edge of the blade.

Examples of knifes of the type to which the invention relates can be clearly found a.o. in the following documents: EP 041 106 and NL 86 01 282 and U.S. Pat. No. 4,766,793.

The knifes described in those patents are positioned in a particular arrangement, above each other, in a cutting block, so that the tubers, mostly potatoes, are cut into bars, mostly French fries, mostly by means of an aqueous jet, at high velocity, through these crosswise arranged knives. In order to allow the knives of a row to be blocked with respect to a row underneath, the knives of an upper row are positioned through positioning sleeves in their lower oblique side, in the knives of a row underneath by means of positioning sleeves in the upper flat side.

These sleeves have the shape of rectangular recesses or recess that are slightly rounded at the bottom side. Although the knives should fit into each other with highest accuracy, and although the greatest care is given to this aspect when mounting the knives, it is always observed that fibres from the tubers built up in the bottom side of the sleeves at the oblique side (see FIG. 2A). Although this building up may be rather insignificant, it nevertheless involves that the tubers (potatoes) is cut into the bars (French fries) are cut in an imperfect manner. In addition to this it is observed that after a period of time, the right angles that are formed at the cutting edge 2, when applying the positioning sleeves 4, tend to fold away at the points 4', so that as a consequence impurities emerge during the cutting. This is exemplified in FIG. 3B. This folding away is caused by the contact of the edges 4' of the positioning sleeves 4 and the cutting edge 2 with the flank 5 of the knife underneath, when during the cutting the knives are forced somewhat apart by the tuber.

It is the aim of this invention to develop a knife of the above described type, which does not show the above described disadvantages and which allows to produce purely cut bars.

To achieve this according to the invention, each sleeve shows in the oblique side a slanting cut bottom side.

In a first possible embodiment said bottom side of the sleeve is formed by a flat or arcuate slanted cutting edge.

In a second possible embodiment, said bottom side of the sleeve is formed by the edge of a conical bore applied throughout the blade of the knife.

According to another possible embodiment, the bottom side of said sleeve is formed by the edge of an arcuate cut out provided in the blade of the knife.

Other details and particularities will appear from the description of the knife for cutting tuberous plants, mainly potatoes, into bars according to this invention. This description is only given as an example and does not limit the invention. The reference numbers relate to the attached figures of the knife of this invention.

FIG. 1 is a representation in perspective of a knife that has generally been used up to now.

FIG. 6A is a representation in perspective of a knife according to the invention (second bodiment).

FIG. 6B shows at an enlarged scale, a positioning sleeve of a knife according to FIG. 6A.

FIG. 7A a representation in perspective of a knife according to the invention (third embodiment).

FIG. 7B shows at an enlarged scale, a positioning sleeve of a knife according to FIG. 7A.

Figure 8A:
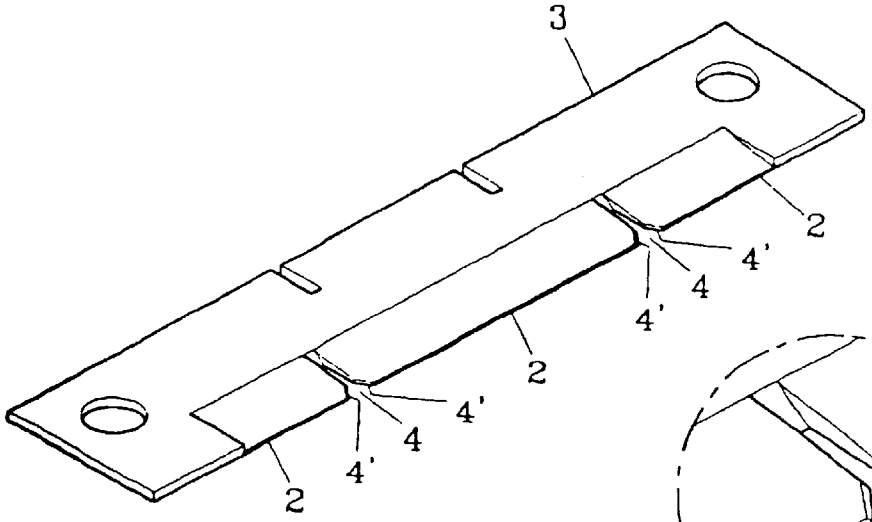

FIG. 8A is a representation in perspective of a knife according to the invention (fourth embodiment).

Figure 8B:
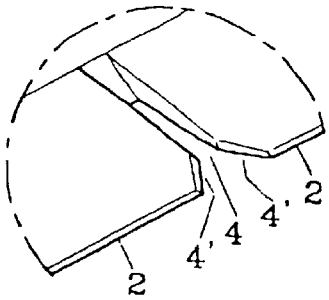

FIG. 8B shows, at an enlarged scale, a positioning sleeve of a knife according to FIG. 8A.

Figure 9A:
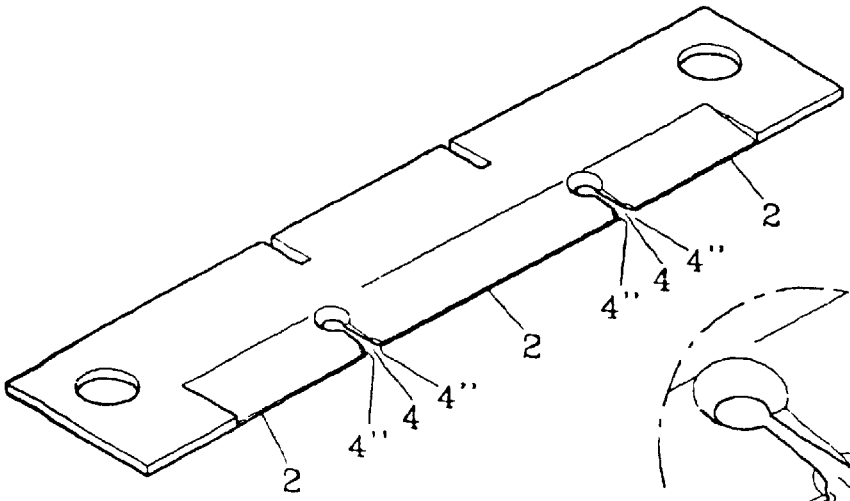

FIG. 9A is a representation in perspective of a knife according to the invention (variation to the fourth embodiment).

Figure 9B:
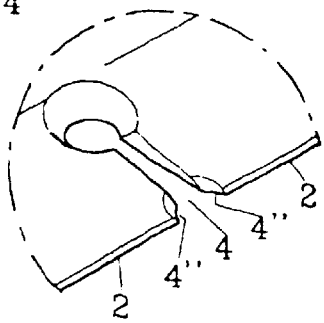

FIG. 9B shows at an enlarged scale, a positioning sleeve of a knife according to FIG. 9A.

Figure 4A:
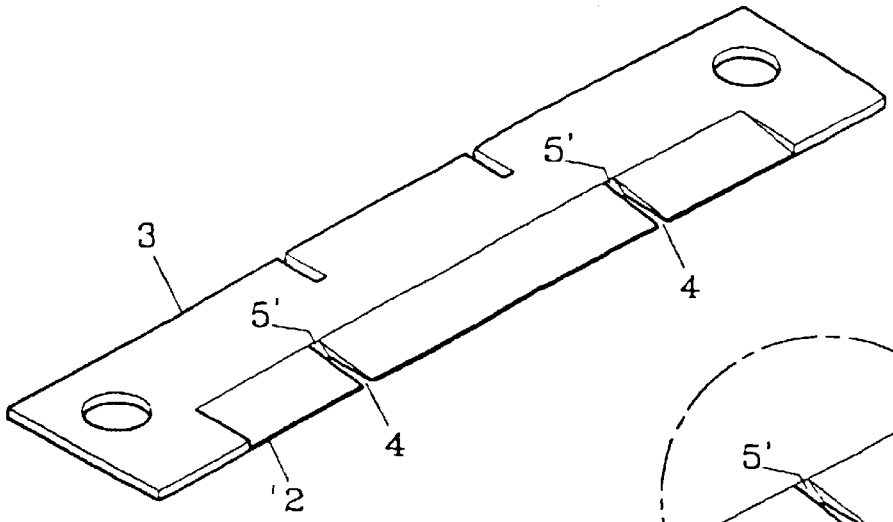
FIG. 4A is a representation in perspective of a knife of this invention (first embodiment with flat cutting edge).
Figure 4B:
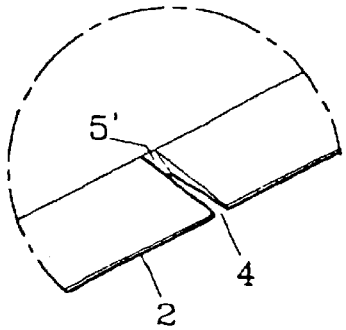
FIG. 4B shows at an enlarged scale, a detail of the knife according to FIG. 3A.

FIG. 10A is a representation in perspective of a knife according to the invention (fifth embodiment) in combination with the positioning sleeve according to FIG. 4A.

FIG. 10B shows at an enlarged scale, an arcuate material cut out of a knife according to FIG. 10A in combination with positioning sleeves according to FIG. 4A.

FIG. 10C is a representation in perspective of two knifes of the invention, mounted crosswise above each other, whereby the edge 1 of the positioning sleeve 2 of the knife 3 lying on top, appears not to touch the blade of the knife 4 underneath, and remains free of distortion, here shown in combinational a positioning sleeve according to FIG. 4A.

FIG. 10D shows at an enlarged scale the intersection of two mounted knifes according to FIG. 10C.

FIG. 11A is a variation to FIG. 10A and is a representation in perspective of a knife according to the invention (fifth embodiment) in combination with a positioning sleeve according to FIG. 7A.

FIG. 11B shows at an enlarged scale an arcuate removal of material from a knife according to FIG. 10B in combination with positioning sleeves according to FIG. 7A.

FIG. 11C is a representation in perspective, of two knifes mounted crosswise above each other according to the invention (fifth embodiment), described in FIG. 10C, but in combination with the positioning sleeves according to FIG. 7A.

FIG. 11D shows at an enlarged scale the intersection of two mounted knifes according to FIG. 10G.

FIG. 12A is a representation in perspective of a knife according to the invention (sixth embodiment) in combination with positioning sleeves according to FIG. 4A.

FIG. 12B shows at an enlarged scale a conical removal of material from a knife according to FIG. 11A in combination with positioning sleeves according to FIG. 4A.

FIG. 12C shows a representation in perspective of two knifes, mounted crosswise above each other according to the invention (sixth embodiment), described FIG. 10C.

FIG. 12D show at an enlarged scale the intersection of two mounted knifes according to FIG. 11C.

FIG. 13A is a representation in perspective of a knife according to the invention (sixth embodiment) in combination with the positioning sleeve according to FIG. 6A.

FIG. 13B shows at an enlarged scale a conical removal of material from a knife according to FIG. 11A in combination with positioning sleeves according to FIG. 6A.

FIG. 13C shows a representation in perspective of two knifes, mounted crosswise above each other according to the invention (sixth embodiment), described in FIG. 10C, but in combination with the positioning sleeves according to FIG. 6A.

FIG. 13D shows at an enlarged scale the intersection of two mounted knifes according to FIG. 13C.

It will be clear that all mutual combinations of the figures are possible and are also object of the invention.

Figures 1A, 1B:
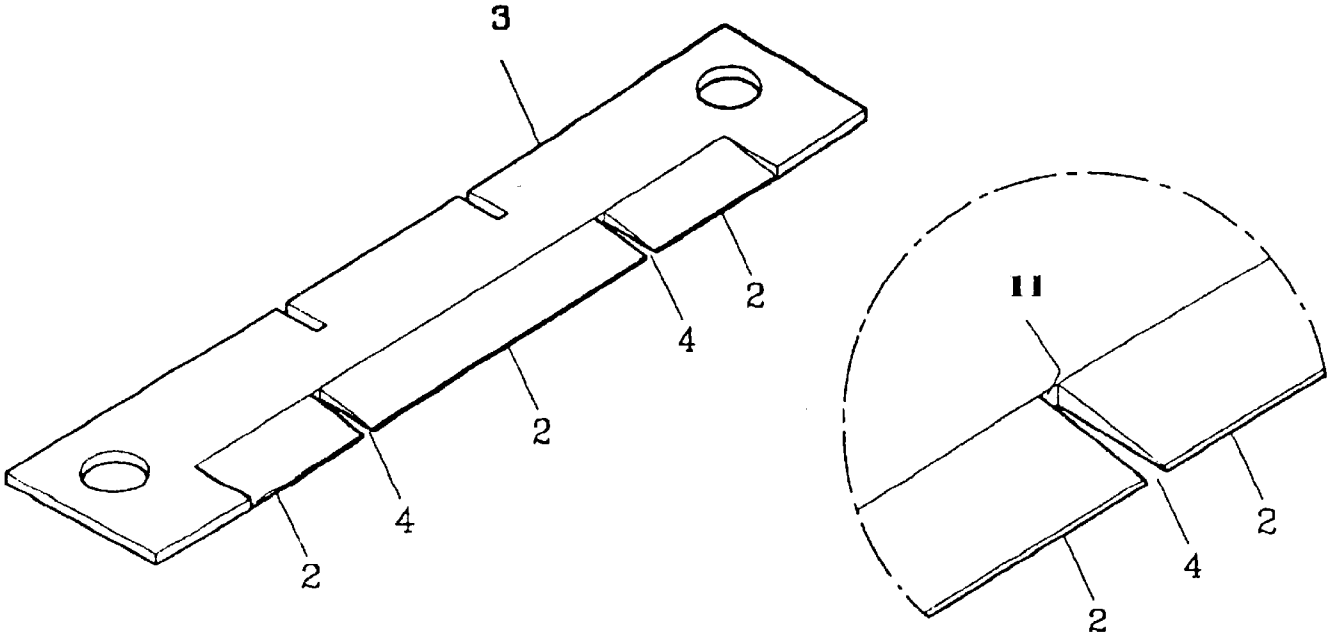
Fig. 1A Prior Art
Fig. 1B Prior Art
FIG. 1B shows at an enlarged scale, a positioning sleeve of a knife according to FIG. 1.

A knife consisting of a blade belonging to what can be called "the state of the art" is shown in FIG. 1. With such a knife, a cutting block can be built up.

Each blade of such a knife has a oblique cutting edge 2 and a non sharpened flat edge 3.

Thus, with these knives a pyramid shaped cutting block can be built up, consisting of several levels of knifes, wherein the two knifes of a level are each time provided orthogonally with respect to the knifes of a joining level. In this way, the required segments, mostly French fries, are cut from the tubers, mostly potatoes.

In order to mutually connect the knifes of the different subsequent levels, each time two positioning sleeves 4 are provided in the oblique cutting edge 2. In the flat edge 3 mostly one or more positioning sleeves are provided. The invention relates mainly to the sleeves in the oblique cutting edge 2.

Figures 2A, 2B:
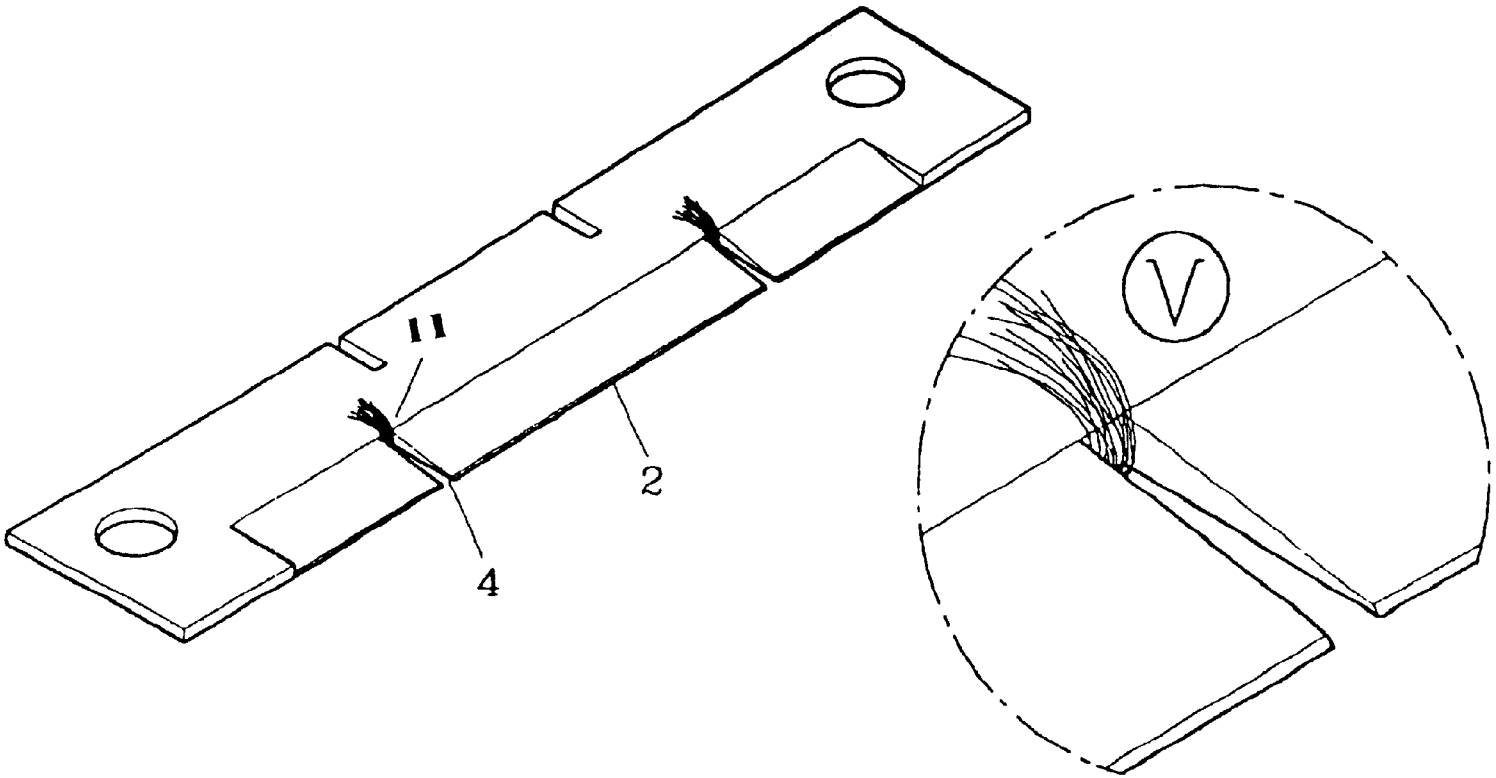
Fig. 2A Prior Art
Fig. 2B Prior Art
FIGS. 2A, 2B, 3A, 3B, illustrate the problems that form the basis of this invention.

The sleeves 4 show a bottom side 11 facing away from the cutting edge 2. In this sleeve 4 another knife is inserted in a crosswise arrangement. In FIG. 2B the fibres V which appear to drape or stack over the thickness of the knife, are shown on an enlarged scale.

The stacking of the fibres at the position of the bottom side 11 of the sleeves 4 may cause the bars that are cut from the tubers to have an impure appearance is due to the fact that the tubers are not properly cut at the position of this little stack where two knifes intersect each other, since at that position an obstruction has emerged. It is indeed clear that the presence of these fibres at this position where the knifes intersect each other, adversely affects the quality and appearance of the cut product.

Within the scope of this invention, a plurality of solution are presented, which allow to cut the tubers (the potatoes) in such a way that the cut product does not show any adverse traces of an unpure cut.

Figures 3A, 3B:
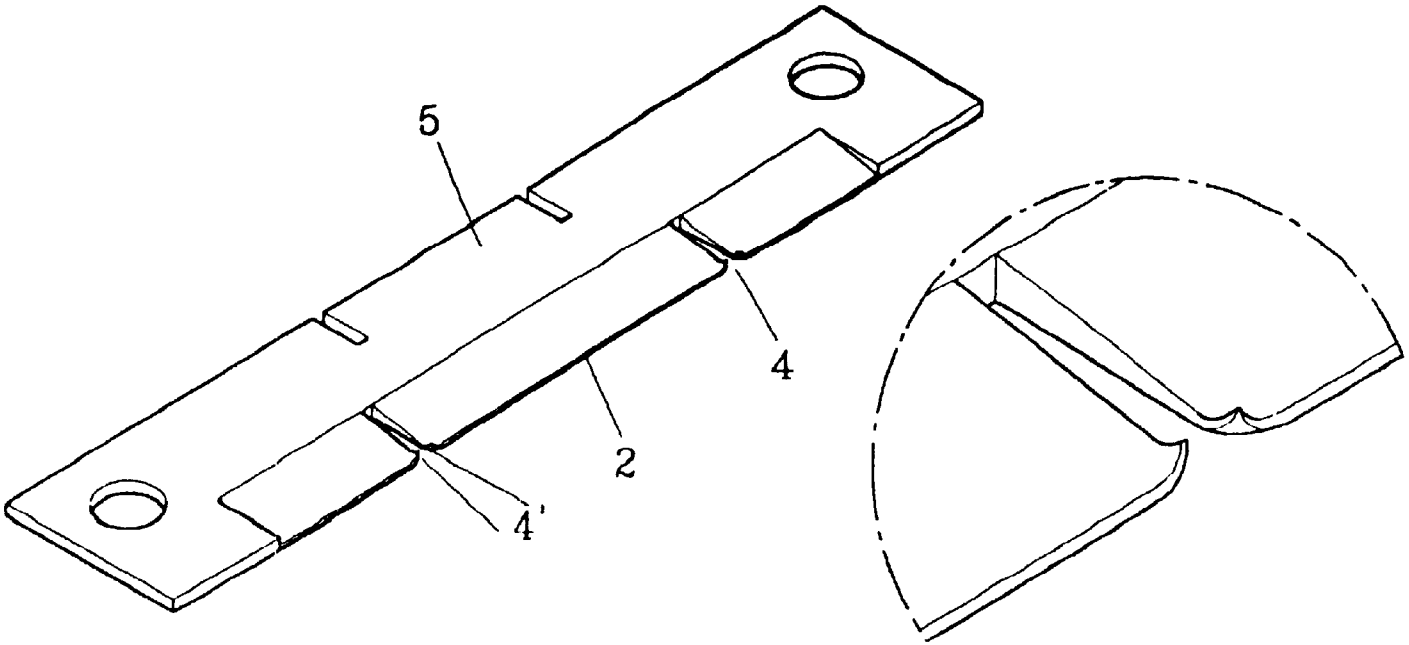
Fig. 3A Prior Art
Fig. 3B Prior Art
Figure 5A:
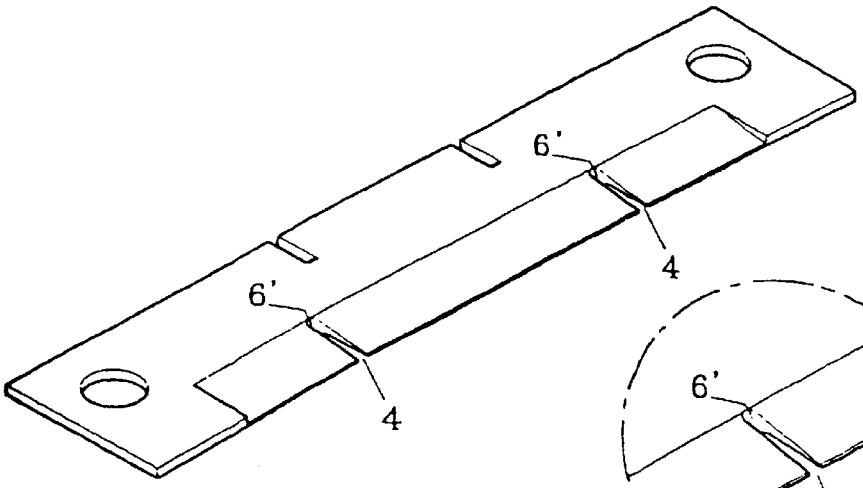
FIG. 5A is a representation in perspective of a knife according to the invention (first embodiment with arcuate cutting edge).
Figure 5B:
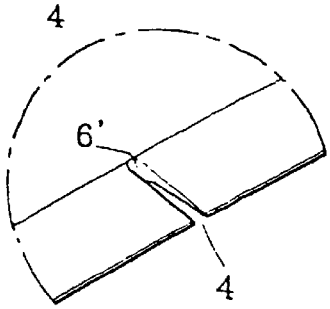
FIG. 5B shows at an enlarged scale, a positioning sleeve of a knife according to FIG. 5A.

In the embodiment of the FIGS. 4A, 4B and 5A, 5B the bottom side of the positioning sleeve 4 is cut out at an oblique angle with respect to the flank 5. During the oblique cutting of the bottom side 5' of the sleeve 4, this cutting can be straight (FIGS. 4A, 4B) or half circle shaped 6' (FIGS. 5A, 5B). After two knifes have been sled into each other, the fibres in the tubers will no longer stack along the flat bottom side of the sleeve in the knifes, but on the contrary will be cut or carried off by the sharp edge of the oblique bottom side 5' or 6'. The stacking of the fibres as is clarified in FIG. 3, should no longer be feared for. The products will now be properly cut.

This is also the case when use is made of knifes according to FIGS. 6A and 6B. According to this embodiment, the bottom side of a sleeve 4 is formed by the sharp edge 7' of a conical bore 7 provided at the position of the bottom side of said sleeve 4. When sliding the knifes that belong to adjacent levels into each other, the bottom side of the sleeve in the flat edge of the knife underneath will not rest on the sharp edge 7' of a conical bore 7.

In another possible embodiment shown in FIGS. 7A and 7B, an arcuate cut out 8 is realised at the position of the bottom side of a sleeve 4. This arcuate cut out shows a cutting edge 8' which involves a pure cutting of the tubers, so that also according to this embodiment no fibres will be formed, so that no accumulation of fibres at the position of the flat edge of the sleeve will occur.

The embodiments to which FIGS. 8A, 8B and 9A, 9B relate are characterised by the sharp cut oblique edges of the parts 4', 4" of the sleeves 4 or one of these parts separately. By setting the edges of said parts 4', 4", a distortion of said parts should no longer be feared for. Moreover, additional building up of fibres is prevented in that the fibres are already cut and removed at this position 4' and 4" of the sleeves. Such a stacking of fibres adversely influences, as has already been explained in the preamble, the appearance aspect of the potatoes or tuberous plants and the like cut into bars. By a sharp setting of said edge parts or one of these parts of said sleeves separately, this problem is solved. During the setting of these edge parts, a rectilinear profile (sleeve part 4" in FIGS. 9A, 9B) can be obtained.

Another embodiment to which FIGS. 10A and 12 relate, is characterised by the removal of material from one or two flanks 5 in the knife underneath of two subsequent levels at the position where the tips of the knife lying on top tend to touch the knife underneath. By said removal of material, it is prevented that tip 1 would get distorted due to contact with the knife underneath and in that way would adversely affect the quality and appearance of the cut bars.

What is claimed is:

1. A knife for cutting tuberous plants whereby the tubers are driven through a cutting bloc formed by crosswise arrangement of knives, the knife comprising a flank portion and a longitudinal edge having an oblique cutting edge, the knife positionable with respect to the knives in sleeves provided perpendicularly to the cutting edge of the blade, at least one sleeve having an oblique cut bottom side.

2. A knife as claimed in claim 1, wherein the bottom side of said sleeve comprises a planar surface.

3. A knife as claimed in claim 1, wherein the bottom side of said sleeve comprises an arcuate surface.

4. A knife as claimed in claim 1, wherein the bottom side of said sleeve comprises a rim of a conical depression in the flank portion of the knife.

5. A knife as claimed in claim 1, wherein the bottom side of said sleeve an edge of an arcuate depression in the flank portion of the knife.

6. A knife as claimed in claim 1, wherein the sleeve comprises edge parts adjacent the cutting edge diverge from each other.

7. A knife as claimed in claim 6, wherein said edge parts of the sleeve diverge in a concave manner.

8. A knife as claimed in claim 1, wherein a conical depression is formed in the flank portion of the knife, the depression being aligned with a tip part at the intersection of one of the edge parts and the cutting edge of the sleeve of the second knife to reduce contact between the flank of the knife and the tip part of the sleeve of at least one of the knives.

9. A knife as claimed in claim 1, wherein an arcuate depression is formed in the flank portion of the knife, the depression being aligned with a tip part at the intersection of one of the edge parts and the cutting edge of the sleeve of the second knife to reduce contact between the flank of the knife and the tip part of the sleeve of at least one of the knives.

* * * * *